US009084704B2

(12) United States Patent
Oberst

(10) Patent No.: US 9,084,704 B2
(45) Date of Patent: Jul. 21, 2015

(54) LIMB SUPPORT DEVICE

(71) Applicant: Dawn Oberst, Combine, TX (US)

(72) Inventor: Dawn Oberst, Combine, TX (US)

(73) Assignee: Dawn Oberst, Combine, TX (US)

( * ) Notice: Subject to any disclaimer, the term of this patent is extended or adjusted under 35 U.S.C. 154(b) by 13 days.

(21) Appl. No.: 13/902,146

(22) Filed: May 24, 2013

(65) Prior Publication Data

US 2013/0340171 A1 Dec. 26, 2013

Related U.S. Application Data

(60) Provisional application No. 61/662,663, filed on Jun. 21, 2012.

(51) Int. Cl.
*A61G 7/075* (2006.01)
*A61G 13/12* (2006.01)

(52) U.S. Cl.
CPC ..... *A61G 7/075* (2013.01); *A61G 13/1205* (2013.01); *A61G 13/1235* (2013.01); *A61G 13/1245* (2013.01)

(58) Field of Classification Search
CPC ..... A47G 9/1009; A47G 9/1081; A47G 23/0625; A47G 7/075; A47G 13/12; A61G 7/065; A61G 13/1235; A61G 13/1245
USPC ..... 5/8, 630, 632, 639, 643, 645, 646, 648, 5/652; 128/845; 220/17.1, 17.3, 914; 206/570, 503, 505, 518; D6/382
See application file for complete search history.

(56) References Cited

U.S. PATENT DOCUMENTS

| | | | | | |
|---|---|---|---|---|---|
| 561,562 | A | * | 6/1896 | Brownson et al. | 248/118 |
| 1,349,072 | A | | 8/1920 | Lines | |
| 2,351,849 | A | | 6/1944 | Wells et al. | |
| 2,531,724 | A | | 11/1950 | Cevasco | |
| 3,532,336 | A | * | 10/1970 | Baker | 5/650 |
| D222,349 | S | | 10/1971 | Sorenson | |
| 3,835,482 | A | * | 9/1974 | Tersch | 4/573.1 |
| 3,931,654 | A | | 1/1976 | Spann | |
| 3,946,451 | A | | 3/1976 | Spann | |
| 3,995,846 | A | | 12/1976 | Frick | |
| 4,166,459 | A | * | 9/1979 | Nightingale | 602/35 |
| 4,270,235 | A | * | 6/1981 | Gutmann | 5/646 |
| D277,316 | S | | 1/1985 | Meares | |
| 4,579,324 | A | | 4/1986 | McConnell | |

(Continued)

FOREIGN PATENT DOCUMENTS

CN 201098225 Y 7/2007

*Primary Examiner* — Nicholas Polito
*Assistant Examiner* — David R Hare
(74) *Attorney, Agent, or Firm* — Edwin S. Flores; Chalker Flores, LLP

(57) ABSTRACT

A limb support device for patient care comprising a non-deformable, non-porous hollow polyhedron comprising a top surface, a bottom, and first, second, third and fourth sides; wherein the top surface and a first side are connected along an edge of each and form an obtuse angle; wherein the second side is connected to the top surface opposite the first side and forms an obtuse angle with the top; wherein the third and fourth sides are disposed opposite each other and between the first and second sides; wherein the bottom is open and further comprises one or more lips, each lip formed along the edge and extending outwardly from the opening in the bottom along the edge of at least one of the first, second, third and fourth sides to provide a handle; and wherein the top is defined further as comprising a channel for the support/positioning of a patient's extremity.

21 Claims, 7 Drawing Sheets

(56) References Cited

U.S. PATENT DOCUMENTS

| | | | | | |
|---|---|---|---|---|---|
| D321,562 | S | * | 11/1991 | Ljungvall | D24/183 |
| D327,198 | S | | 6/1992 | Erker, Jr. et al. | |
| 5,149,033 | A | * | 9/1992 | Burzler | 248/176.1 |
| D336,134 | S | | 6/1993 | Kalatsky | |
| D345,797 | S | | 4/1994 | Gardner | |
| D347,476 | S | | 5/1994 | McDonald | |
| 5,390,682 | A | * | 2/1995 | Iams | 5/632 |
| D359,190 | S | | 6/1995 | Hargest et al. | |
| D359,804 | S | | 6/1995 | Carter | |
| 5,431,618 | A | | 7/1995 | Levi | |
| 5,452,728 | A | * | 9/1995 | Iams | 5/630 |
| 5,477,866 | A | | 12/1995 | Davenport | |
| 5,542,910 | A | * | 8/1996 | Oliver | 602/18 |
| 5,634,568 | A | * | 6/1997 | Wawrzyniak | 220/510 |
| D413,981 | S | | 9/1999 | Swedberg et al. | |
| 6,026,812 | A | * | 2/2000 | Lipson et al. | 128/882 |
| 6,032,669 | A | | 3/2000 | Klein | |
| 6,065,166 | A | * | 5/2000 | Sharrock et al. | 5/630 |
| 6,085,371 | A | | 7/2000 | Umhofer | |
| 6,221,036 | B1 | * | 4/2001 | Lucas | 602/23 |
| D451,568 | S | | 12/2001 | Gordon | |
| 6,490,742 | B2 | * | 12/2002 | Hall et al. | 5/630 |
| 6,572,573 | B1 | | 6/2003 | Klein | |
| 6,578,218 | B2 | * | 6/2003 | Wassilefsky | 5/648 |
| 6,715,170 | B2 | * | 4/2004 | Richmond | 5/625 |
| 6,920,657 | B2 | | 7/2005 | Murray | |
| 6,931,683 | B1 | * | 8/2005 | Elkin et al. | 5/655 |
| 6,953,443 | B2 | * | 10/2005 | Hay | 602/33 |
| 7,007,328 | B1 | * | 3/2006 | Bailey | 5/632 |
| 7,017,215 | B1 | * | 3/2006 | Singer et al. | 5/646 |
| D521,301 | S | | 5/2006 | Dickson | |
| 7,036,169 | B2 | * | 5/2006 | Marshall | 5/650 |
| 7,111,347 | B1 | * | 9/2006 | Cottrell | 5/655 |
| 7,118,544 | B2 | | 10/2006 | Murray | |
| 7,150,057 | B1 | | 12/2006 | Santiago et al. | |
| D539,066 | S | | 3/2007 | Coquillette | |
| D599,603 | S | | 9/2009 | Berland et al. | |
| D610,852 | S | | 3/2010 | Rothschild et al. | |
| 7,908,691 | B2 | | 3/2011 | Small | |
| D642,694 | S | | 8/2011 | Sharps et al. | |
| 8,220,085 | B2 | * | 7/2012 | Claffy et al. | 5/8 |
| D680,654 | S | | 4/2013 | Borreli | |
| 8,590,848 | B1 | * | 11/2013 | Newlen | 248/118 |
| 8,671,481 | B2 | * | 3/2014 | Franklin | 5/636 |
| 2002/0128575 | A1 | | 9/2002 | Robinson et al. | |
| 2003/0182727 | A1 | | 10/2003 | DuDonis et al. | |
| 2003/0208846 | A1 | | 11/2003 | Guarino | |
| 2004/0215122 | A1 | * | 10/2004 | Hansen | 602/23 |
| 2006/0288486 | A1 | | 12/2006 | Kidwell | |
| 2007/0095353 | A1 | * | 5/2007 | Ravikumar | 128/845 |
| 2007/0294829 | A1 | | 12/2007 | Callahan et al. | |
| 2008/0109960 | A1 | * | 5/2008 | Brown et al. | 5/636 |
| 2008/0115285 | A1 | * | 5/2008 | Hiatt | 5/632 |
| 2009/0145442 | A1 | * | 6/2009 | Hecox et al. | 128/845 |
| 2012/0024295 | A1 | * | 2/2012 | Mihin | 128/845 |
| 2013/0340171 | A1 | | 12/2013 | Oberst | |

* cited by examiner

LIMB SUPPORT DEVICE

CROSS-REFERENCE TO RELATED APPLICATIONS

This application claims priority based on U.S. Provisional Application No. 61/662,663, filed Jun. 21, 2012, the contents of which are incorporated by reference in their entirety.

TECHNICAL FIELD OF THE INVENTION

The present invention relates in general to the field of patient care, and more particularly, to an apparatus and method for providing patient support when a medical care provider needs access to, and is treating, wounds on the patient's extremities.

STATEMENT OF FEDERALLY FUNDED RESEARCH

None.

INCORPORATION-BY-REFERENCE OF MATERIALS FILED ON COMPACT DISC

None.

BACKGROUND OF THE INVENTION

Without limiting the scope of the invention, its background is described in connection with limb support devices.

U.S. Pat. No. 3,946,451, issued to Spann, teaches a limb support and the like is formed from a block of polyurethane foam having resilient characteristics, capable of permitting the passage of air and being of such configuration as to include a continuous open topped arcuate groove extending longitudinally along the length of the block for receiving, cradling and resiliently gripping the limb of a hospitalized patient to avoid rotation of the limb supported thereby.

U.S. Pat. No. 4,270,235, issued to Gutmann is directed to an arm support pillow. Briefly, a support device for the arms of convalescent patients for providing comfort and stability and for preventing circulation problems includes an inclined cushion provided with ridges on either side to prevent the arm from falling off and an angled shape to provide stability and comfort for the patient.

U.S. Pat. No. 5,477,866, issued to Davenport is directed to a leg support pillow. Briefly, a support pillow for the leg and foot comprising a substantially solid foam member, the foam member being of uniform cross-section and having a first support arm rising to a first height, a second support arm rising to a second height, and a support channel located therebetween. The height of the first support arm is selected to prevent sideward or rotational movement of the foot.

U.S. Pat. No. 6,032,669, issued to Klein teaches a positioning pillow for approximating anatomic position in lateral decubitus position. Briefly, a surgical support for positioning a patient's lateral thighs during liposuction thereof, wherein the support comprises an elongate pillow positionable between the thighs of the patient such that a respective one of the patient's lateral thighs is maintained in an upwardly-oriented position and abducted from the patients body such that the greater trochanter of the femur of such abducted leg is rotated interiorally and medially to such a degree that pseudobulging of the greater trochanter is eliminated or substantially minimized. The pillow preferably includes a tapered proximal end oriented to be positioned towards the crotch of the patient and a gradually upwardly-extending distal end that defines a top support surface upon which the lateral thigh is intra-operatively positioned. The support further is provide with a passageway formed therewithin and pillow along the length thereof to accommodate the respective other leg of the patient so that the patient may assume the lateral decubitus position while approximating the anatomic position.

U.S. Pat. No. 7,150,057, issued to Santiago, et al., is directed to a lower leg and foot pillow. Briefly, a pillow approximately like the letter P in a prone position with a substantially flat or even top or upper surface that upwardly underlies the lower legs, beginning from the calves towards the heels, of the supine user to relieve stress or leg fatigue from long hours of work, shopping, standing or walking, to improve blood circulation and to help prevent varicose veins. It is made of spongy or resilient material, and covered by an inner overlay as a lining and a replaceable outer outlay as a pillowcase. It is intended for use at home, office or any room or place with adequate space.

SUMMARY OF THE INVENTION

The present invention overcomes the problems with the prior art, which include limited use for each device while performing patient care, e.g., the devices are configured to specific body parts or positions, and the design and selection of materials are inapplicable for wound treatment situations.

The present invention provides a new and improved limb support device that requires no assembly, is versatile for a wide array of patient populations, and is stable and comfortable to use due to its design, size and shape. The present invention can be used for a variety of injuries to extremities and is also effective for use with multiple types of wound care dressings and treatments. Due to its relatively simple construction, it is cost effective in production and provides for multiple uses for a single patient. In one embodiment, it is of unitary design (e.g., molded), it is safe, it has no sharp edges, screws, pins, hinges, seams, levers or moving parts of any type to injure patient or health care provider. Generally, it can be made of polymers, is easily cleaned/disinfected for reuse, and due to the opening in the bottom, makes it easy to store. The present invention addresses a growing need for health care personnel to support heavy limbs during wound care and improve treatment time and cost savings to the facility. Safety features for staff include better body mechanics, increased comfort to the patient during wound care due to proper support, elevation and stability of the injured extremity. The present invention is versatile for use in hospital, long term, clinical and home care settings with equal effectiveness.

One embodiment of the present invention includes a device for limb support, positioning, and care comprising: a non-deformable, non-porous hollow polyhedron comprising of a top, a bottom, and first, second, third and fourth sides; wherein the top and a first side are connected along an edge of each and form an obtuse angle; wherein the second side is connected to the top, opposite the first side, and forms an obtuse angle with the top; wherein the third and fourth sides are disposed opposite each other and between the first and second sides; wherein the bottom is open and further comprises one or more lips, each lip formed along the edge and extending outwardly from the opening in the bottom along the edge of at least one of the first, second, third and fourth sides; and wherein the top is defined further as a channel in the form of, e.g., an elongated elliptical groove extending from the first side to the second side. In one aspect, the device is stackable through the open bottom of adjacent stacked devices. In another aspect, the one or more lips of the bottom edges comprise a handle. In another aspect, the one or more lips provide increased stability to the device when positioned on a bed or other flat surface. In another aspect, the device is substantially rigid. In another aspect, the at least one of the third and fourth sides, the top and bottom, or the first and second sides are bicentric quadrilaterals. In another aspect, the device is defined further as a container adapted to, at least one of, carry and/or store supplies.

Yet another embodiment of the present invention includes a method of treating a wound comprising: identifying a patient in need of wound care; and supporting or positioning the limb of the patient with a device comprising: a non-deformable, non-porous hollow polyhedron comprising a top, a bottom, and first, second, third and fourth sides, wherein the top and a first side are connected along an edge of each and form an obtuse angle; wherein the second side is connected to the top, opposite the first side, and forms an obtuse angle with the top; wherein the third and fourth sides are disposed opposite each other and between the first and second sides; wherein the bottom is open and further comprises one or more lips, each lip formed along the edge and extending outwardly from the opening in the bottom along the edge of at least one of the first, second, third and fourth sides; and wherein the top is defined further as comprising a channel, e.g., an elongated elliptical groove extending from the first side to the second side. In one aspect, the device is stackable through the open bottom of adjacent stacked devices. In another aspect, the device further comprises a portion of the one or more lips. In another aspect, the device further comprises a handle. In another aspect, the one or more lips provide increased stability to the device when positioned on a bed or other flat surface. In another aspect, the device is substantially rigid. In another aspect, the at least one of the third and fourth sides, the top and bottom, or the first and second sides are bicentric quadrilaterals. In another aspect, the opening is adapted to at least one of carry supplies or store supplies.

Yet another embodiment of the present invention includes a medical device and container for limb care comprising: a non-deformable, non-porous hollow container comprising a top, a bottom, and a first, second, third and fourth sides; wherein the top and a first side are connected along an edge of each and form an obtuse angle; wherein the second side is connected to the top, opposite the first side, and forms an obtuse angle with the top; wherein the third and fourth sides are disposed opposite each other and between the first and second sides; wherein the bottom is open and further comprises one or more lips, each lip formed along the edge and extending outwardly from the open bottom along the edge of at least one of the first, second, third and fourth sides; and wherein the top is defined further as comprising a channel in the form of, e.g., an elongated elliptical groove extending from the first side to the second side. In one aspect, the device is stackable through the open bottom of adjacent stacked devices. In another aspect, the device further comprises a portion of the one or more lips to comprise a handle. In another aspect, the one or more lips provide increased stability to the device when positioned on a surface. In another aspect, the device is substantially rigid. In another aspect, the at least one of the third and fourth sides, the top and bottom, or the first and second sides are bicentric quadrilaterals. In another aspect, the opening is adapted to, at least one of, carrying or storing supplies.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
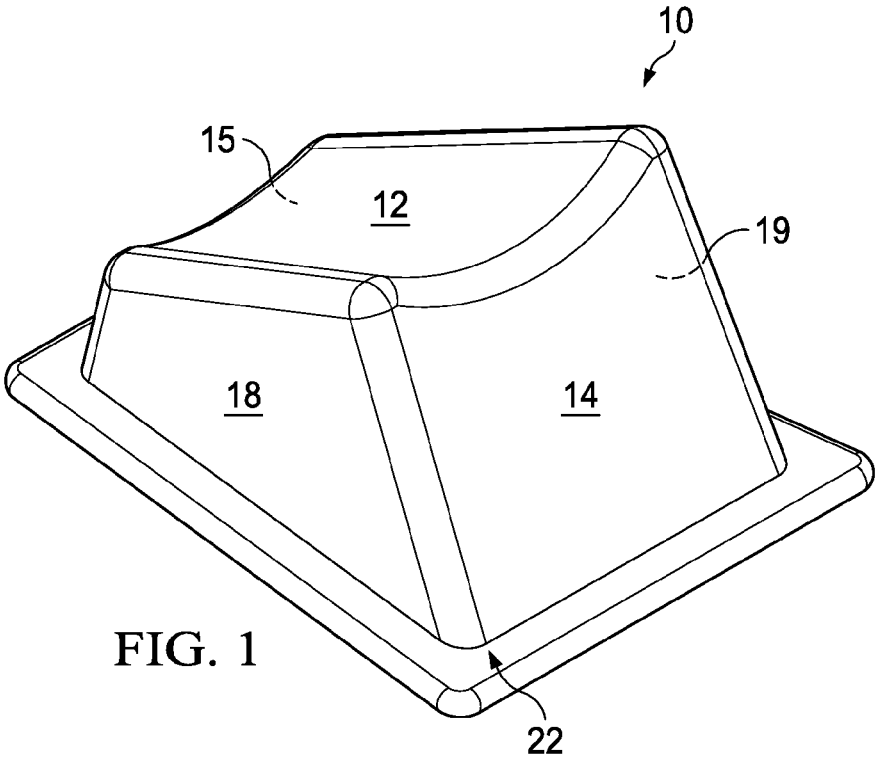
FIG. 1 is an isometric, top view of one embodiment of the limb support device of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

Prior art searches resulted in products that are for surgical positioning with restraints to physically hold extremity in position during a surgical procedure (Universal Extremity Positioner, McConnell, U.S. Pat. No. 4,579,324 Apr. 1, 1998), elevation devices devised to improve healing by affecting the blood flow and fluid flow/edema (Leg support Apparatus—U.S. Pat. No. 6,085,371 Umhofer, Jul. 11, 2000) and (Leg Elevation Device, U.S. Pat. No. D521,301 S1, Dickson, May, 23, 2006), elevation device with support cushion for extremity (Orthopedic block for and with an elevation device for positioning an extremity, U.S. Pat. No. 7,118,544, Murray, Oct. 10, 2006), positioning devices for the comfort of the bed bound patient (Elevation device for Positioning an extremity, U.S. Pat. No. 6,920,657 B2, Murray, Jul. 26, 2005) and (leg Positioner, U.S. Pat. No. 3,931,654, Spann, Jan. 13, 1976), limb restraining/positioning devices to secure a limb for medical imaging or diagnostic testing (MRI's, Xray, bone scans, etc., U.S. Pat. No. 7,036,169, Extremity Positioner, Marshall, May, 2, 2006), limb support for prevention of rotation when patient confined to bed, (Limb Support, U.S. Pat. No. 3,946,451, Spann, Mar. 30, 1976), portable, adjustable limb support for ambulation (Lightweight, portable, positional limb support, U.S. Pat. No. 6,026,812, Lipson, Feb. 22, 2000), heel elevating device to promote circulation, prevent foot drop, pressure reduction (Heel elevating device, Klein, U.S. Pat. No. 6,572,573, Jun. 3, 2003), means supporting an extremity of the body during the application of a cast, U.S. Pat. No. 3,995,846, Frick, Dec. 7, 1976. None of these prior art devices provide a device and methods for the wound care of all extremities. Prior Art (Hall, Hall, Conley & Raynor, U.S. Pat. No. 6,490,742 B2) is designed as a support of appendages for wound care however in the summary it is only described for pressure ulcer care on the heels. In addition, is compromised of a plurality of support members, require friction stacking & mating of surfaces to stabilize. It must be assembled from a minimum of two in height (between 4 to 10 inches) and longitudinal (4 to 24 inches) with each piece/support being 6×5×8 inches. Prior Art (Robinson, U.S. Patent Publication No. US2002/0128575 A1 Sep. 12, 2002) is a limb support for medical treatment. It too is made from multiple pieces requiring assembly and requiring inserting a pin to create a locking assembly. Once assembled this creates a fulcrum to lift an extremity for medical treatment.

The present invention overcomes the deficiencies of the prior art by providing a versatile, stable device that is simple in design without straps, hinges, or moving parts which increase the risks of additional injury to patient. The device design is stable without need of securing to a surface or another object or assembly of multiple parts. The device is fabricated out of a polymer and requires no assembly or attachments to either the patient or a surface/object. Polymers will not absorb body fluids, are easily cleaned, lightweight and cost effective to purchase, manufacture and ship. The simple, stackable design of the present invention allows for easy storage and shipping. Another advantage of the limb support device is the size, which can be used by most patient populations, including adolescent, adult and bariatric patients. The limb support device provides a safe, comfortable means to perform wound care to the patient and also aids in the prevention of back injuries to health care providers by eliminating make shift support with pillows and poor body mechanics to position and hold extremities while providing wound care without the need of an assistant. In addition to temporary use while performing wound care on patient, the device may be inverted with base up to use as a storage bin for the wound care products.

The limb support device can be used when the patient is lying or sitting on a fixed, flat surface such as bed or gurney. The channel, which is shown as an elongated elliptical groove allows the patient's limb to be cradled to support and maintain position, with a wider lipped base adding stability. The limb support device also has an open base that narrows toward the top, which allows for nesting of devices for storage and shipping. Generally, the support device is made of an inexpensive, lightweight plastic/polymer, which can be easily disinfected between uses, which is substantially non-porous (or rendered non-porous). Thus, the present limb support device is cost effective and is durable enough for single use or multiple uses on a single patient, allowing for decreased personnel and increased comfort of patient during wound care. The design of the limb support device allows for different heights based on the rotation of the device, using the lipped base, a rear surface, a side surface or even the front surface as base for positioning the patient's limb for comfort with wound treatment and care.

FIG. 1 is an isometric, top view of one embodiment of the limb support device 10 of the present invention. The limb support device 10 includes a top 12 and a first side 14 and a second side 15 (not shown, see arrow for location), a third and fourth sides (18, 19), and a base that includes a support lip 22. The top 12 is depicted having a channel (or groove), which can have rounded edges, with the intersecting surfaces of the top 12 and sides 14, 15, 18, 19 being generally rounded and smooth for patient comfort.

Figure 2:
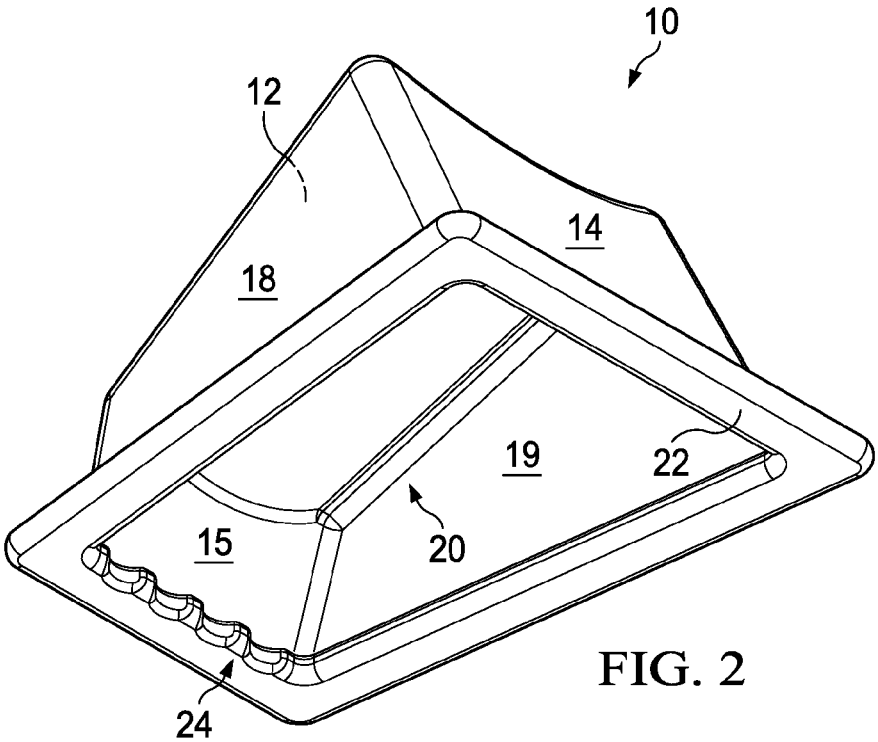
FIG. 2 is an isometric, bottom view of one embodiment of the limb support device of the present invention.

FIG. 2 is an isometric, bottom view of one embodiment of the limb support device 10 of the present invention in which the base is shown having an opening 20 and a handle 24, which opening 20 is formed by the sides (14, 15, 18, 19) with the underside of the top 12 forming a container into which medical and other supplies may be placed when the device is not in use for limb support but may also be used to carry and store supplies.

Figure 3:
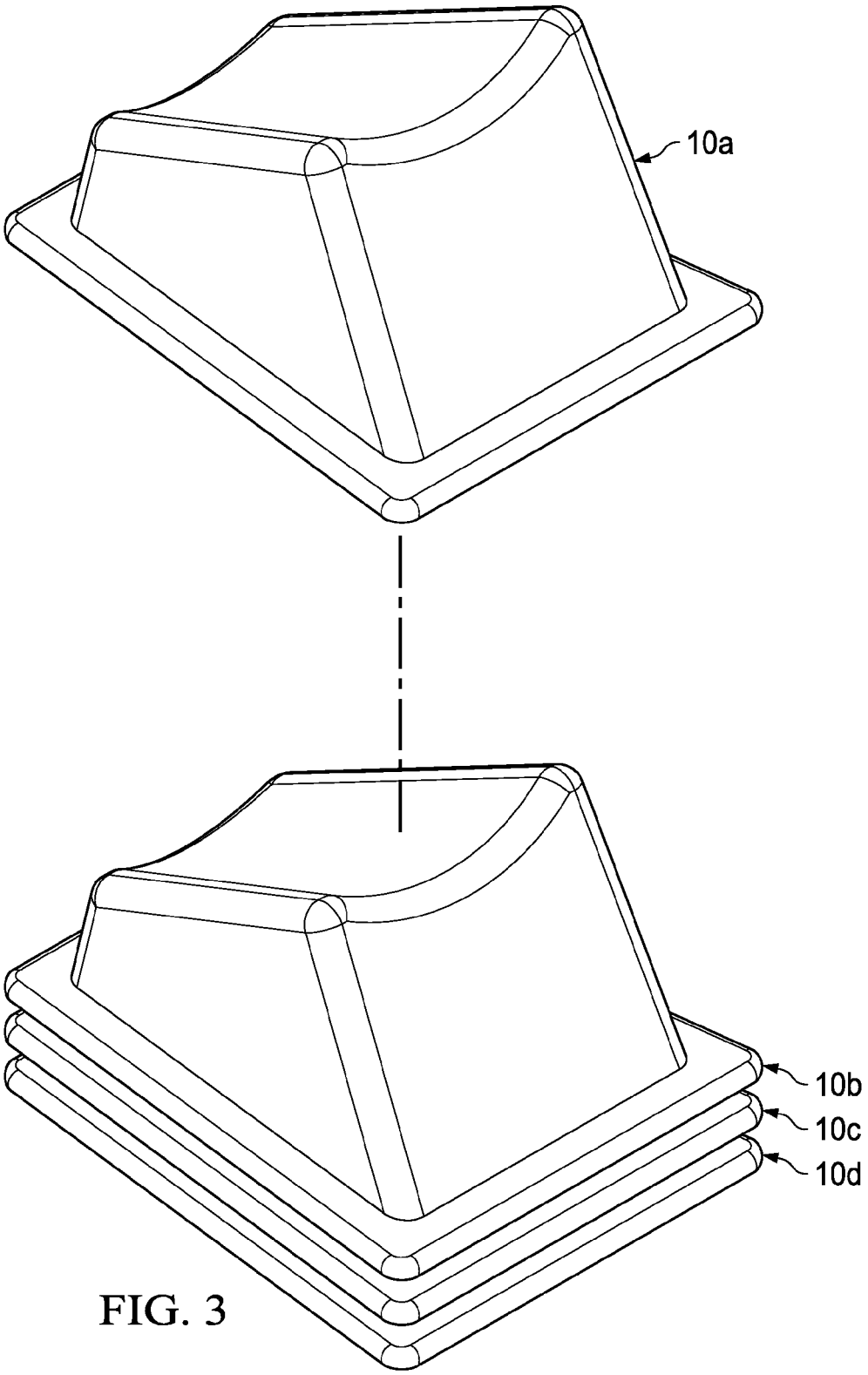
FIG. 3 is an isometric view of multiple limb support devices of the present invention showing that they are stackable for storage.

FIG. 3 is an isometric view of multiple limb support devices 10*a*, 10*b*, 10*c*, 10*d*, of the present invention showing that they are stackable for storage via the opening 20 (not shown).

Figure 4:
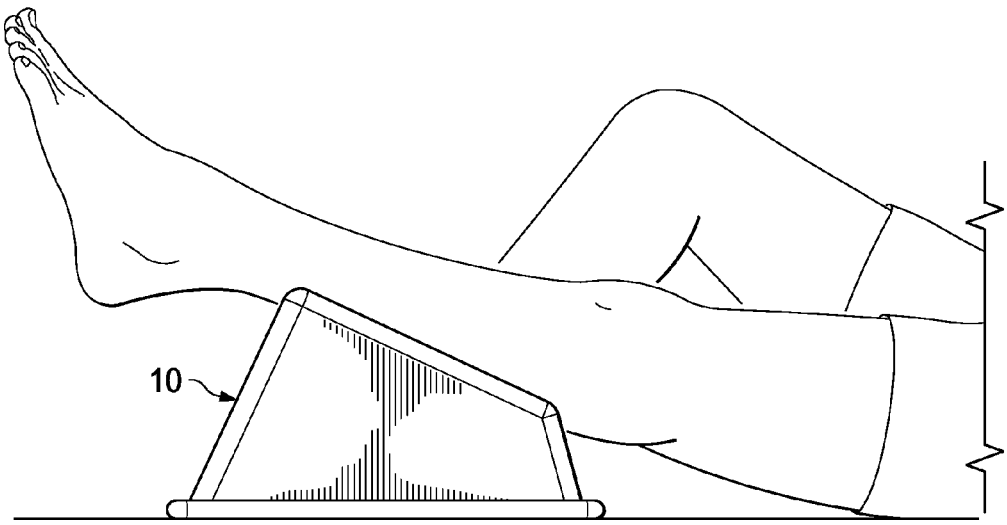
FIG. 4 is a side view of the limb support device with view of the flat rear surface with view of patients thigh, knee, lower leg, ankle and foot in position.

FIG. 4 is a side view of the limb support device 10 with view of the flat rear surface. The base is wider than the apex and has a lipped edge, which gives the device stability. The longitudinal surface has a channel or beveled edge to maintain the limb on the device during wound care. This is the primary position of device for wound care in which the patient's full limb weight can be placed on the limb support device 10 and multiple surfaces on the patient's limb can be accessed. During use, the limb support device 10 provides comfort to the patient and allows the health care provider to use both hands at the same time, without the need to support the limb with one hand, and is a manner that is ergonomic for the health care provider.

Figure 5A:
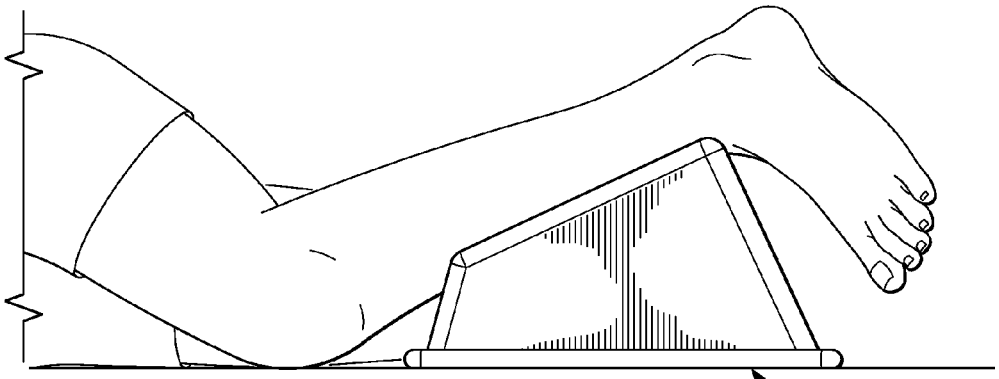
FIGS. 5A and 5B show side views of the device with the patient's limbs in two separate positions.
Figure 5B:
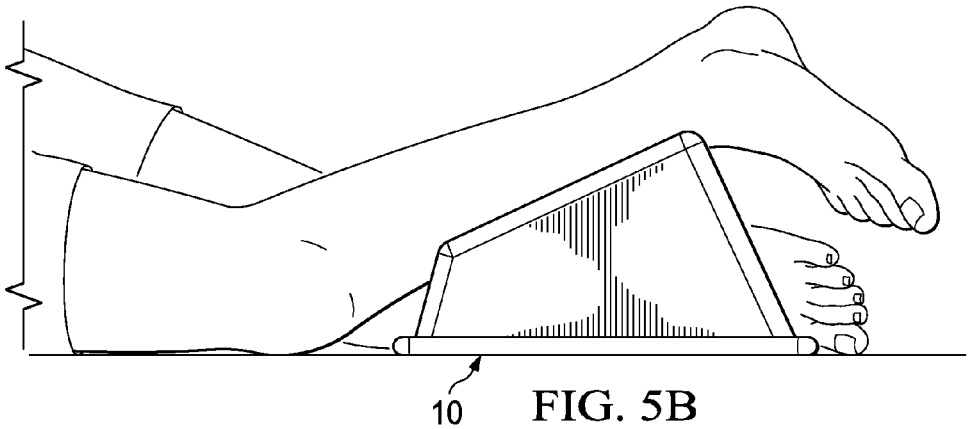

FIGS. 5A and 5B show side views of the limb support device 10 with the limbs in two separate positions. In FIG. 5A the patient is lying on his/her side with the limb support device 10 supporting the medial lower leg/calf, to allow for access to a lateral wound (not shown) on the side of the knee, calf, ankle or foot on the leg in the upper most position, while in FIG. 5B the patient is lying on his/her side with the limb support device supporting the lateral calf providing better access to posterior and medial portions of the calf, leg, ankle or foot on the leg in the lower most position. Again, the full weight of the patient's limb can be placed on the limb support device 10 and multiple surfaces on the sides of the patient's limb can be accessed. During use, the limb support device 10 provides comfort with the positioning and support of limb to the patient and allows the health care provider to use both hands at the same time, without the need to support the limb with one hand, and is a manner that is ergonomic for the health care provider.

Figure 6:
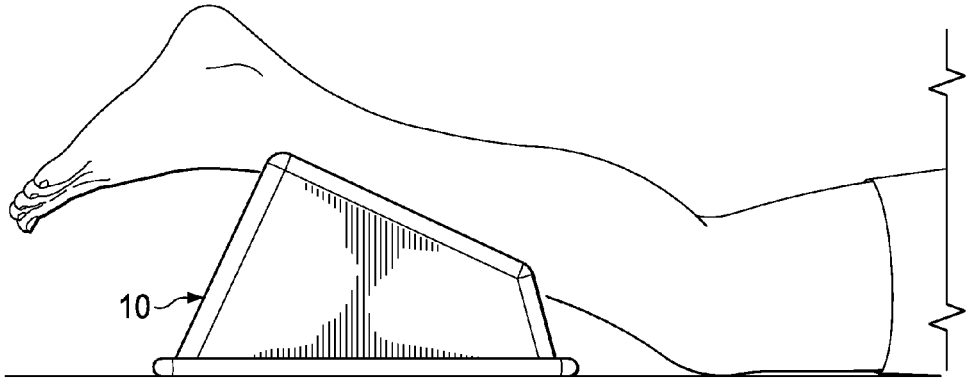
FIG. 6 is a side view of the limb support device positioned to provide better access to posterior popliteal, lower leg, ankle, heel, and plantar wounds of the foot.

FIG. 6 is a side view of the limb support device 10 positioned to provide better access to posterior tarsal and plantar wounds of the foot, ankle, popliteal, and thigh wounds, patient is in prone position. Again, the full weight of the patient's limb can be placed on the limb support device 10 and multiple surfaces on the rear and sides of the patient's limb can be accessed. During use, the limb support device 10 provides comfort to the patient and allows the health care provider to use both hands at the same time, without the need to support the limb with one hand, and is a manner that is ergonomic for the health care provider.

Figure 7:
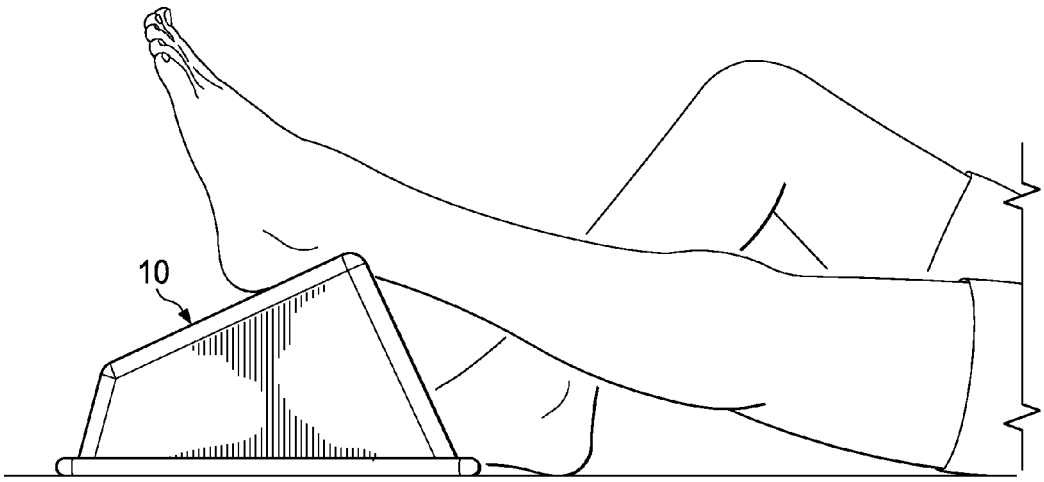
FIG. 7 is a side view of the limb support device for access to crural/thigh, patellar, lower leg, tarsal/ankle, and foot wounds, wherein the posterior tarsal surface rests on the top of the device.

FIG. 7 is side view of limb support device 10 in for access to anterior thigh, patellar, lower leg tarsal/ankle, and foot wounds, wherein the posterior tarsal surface rests on the top of the device. The full weight of the patient's limb can be placed on the limb support device 10 at the ankle, and multiple surfaces on the top, bottom and sides of the patient's limb can be accessed. During use, the limb support device 10 provides comfort during positioning and support to the patient and also allows the health care provider to use both hands at the same time, without the need to support the limb with one hand, and is a manner that is ergonomic for the health care provider.

Figure 8A:
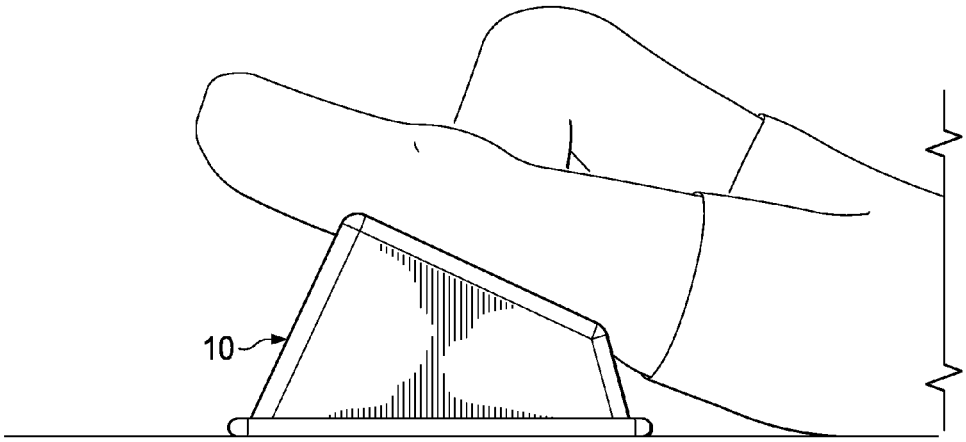
FIGS. 8A and 8B show another side view of the limb support device positioned for wound care to limb amputated below the knee (FIG. 8A) that is positioned within a channel on the surface of the device, while FIB. 8B shows an amputation above the knee.
Figure 8B:
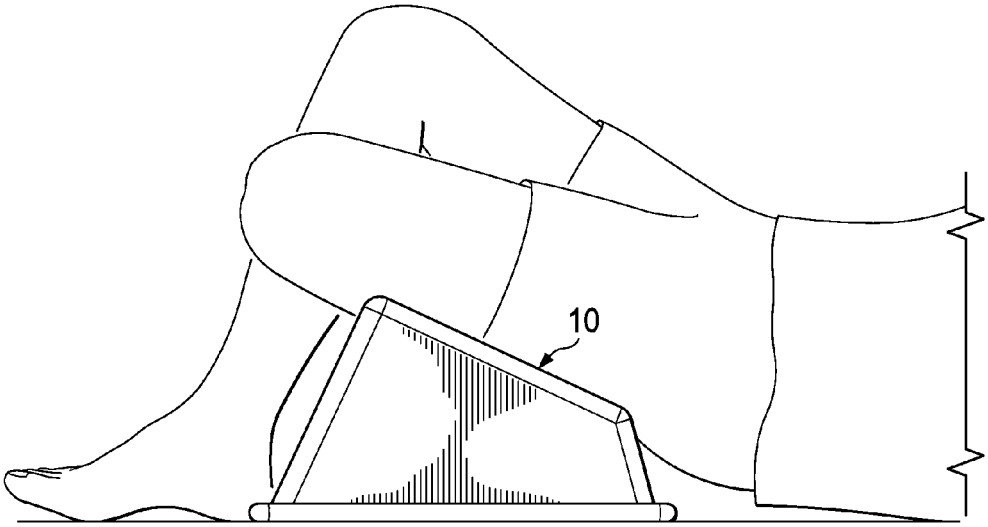

FIGS. 8A and 8B show another side view of the limb support device 10 positioned for wound care to a limb with a below the knee amputation (FIG. 8A) that is positioned on the channel of the device, while FIG. 8B shows the patient's leg amputated above the knee being supported by the limb support device 10. The full weight of the patient's amputated limb can be placed on the limb support device 10 at the thigh, and multiple surfaces on the top, bottom and sides of the patient's limb can be accessed.

Figure 9:
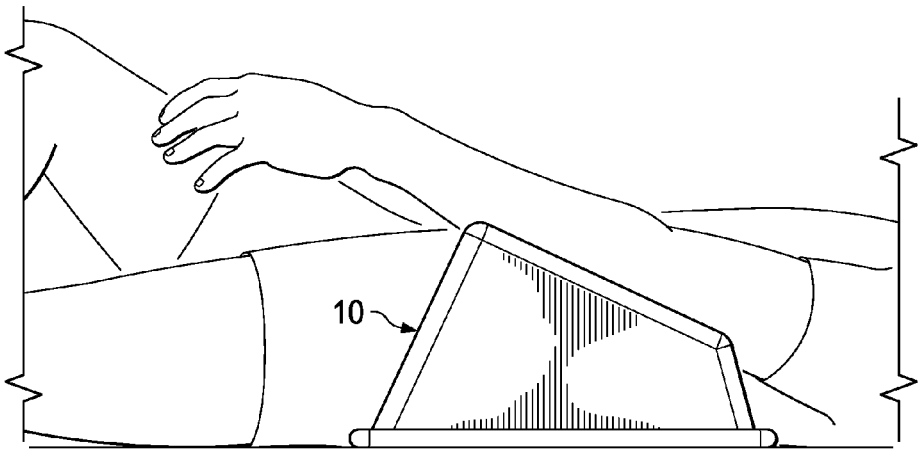
FIG. 9 is a side view of the limb support device positioned for wound care of the hand and/or wrist, or limb on the channel surface.

FIG. 9 is a side view of the limb support device 10 positioned for wound care of the hand, wrist and/or arm, or limb resting in the channel. The full weight of the patient's arm, wrist and hand can be placed on the limb support device 10, and multiple surfaces on the top, bottom and sides of the patient's arm, wrist and hand can be accessed.

Figure 10:
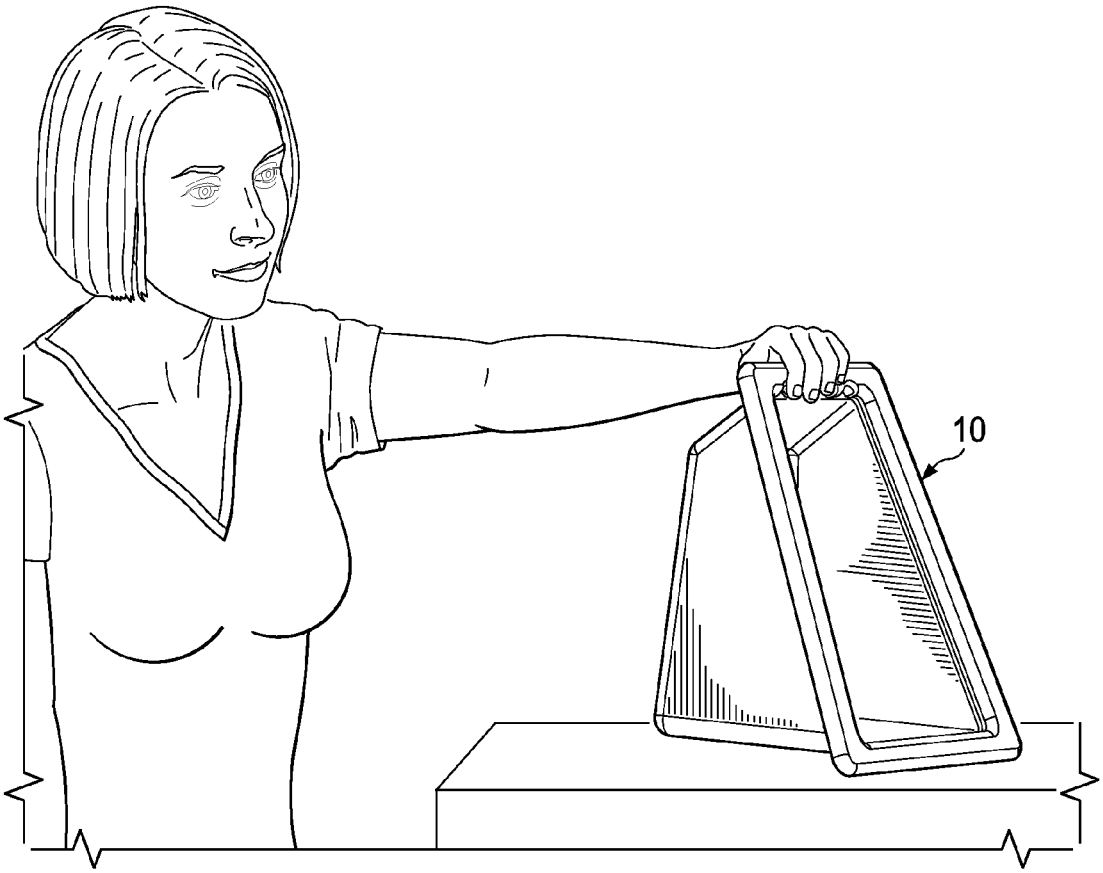
FIG. 10 is an isometric view of the limb support device positioned for wound care of the shoulder, upper arm, elbow, forearm and wrist, so that the patient may hold onto the device handle to position/stabilize limb.

FIG. 10 is an isometric view of limb support device 10 positioned for wound care of the shoulder, upper arm, elbow and wrist, patient may hold onto device or rest above wrist on front. The full weight of the patient's limb can be placed on the limb support device 10 by asking the patient to hold the device (as depicted) or the patient can lean the limb or portion thereof on the limb support device 10. Again, multiple surfaces on the top, bottom and sides of the patient's arm, elbow, and shoulder can be accessed. During use, the limb support device 10 provides comfort to the patient while supporting and positioning the limb and also allows the health care provider to use both hands at the same time, without the need to support the limb with one hand, and is a manner that is ergonomic for the health care provider.

Figure 11:
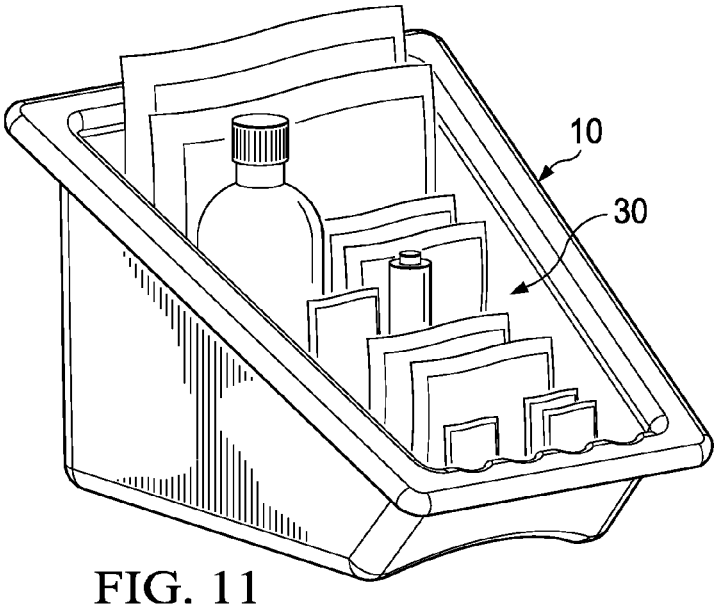
FIG. 11 is an isometric view of the limb support device used as a carrier and storage for wound care and other medical supplies.

FIG. 11 is an isometric view of the limb support device 10 used as a carrier or caddy for wound care and other medical supplies 30. As depicted a plurality of medical supplies 30 are depicted, however, it will be common for the health care provider to place that equipment and supplies needed for the wound assessment, treatment and dressing applications. For example, the health care provider could carry scissors, wound cleansers, specialty dressing supplies, topical products, and tape when assessing and treating/dressing wounds on extremities, Thus, the present invention includes a one-piece molded polymer limb support device that can be repositioned to provide numerous positions for support of both upper and lower extremities to provide wound access for the purpose of performing wound care and dressing changes. The limb support device 10 operates with no attachments or assembly required, is portable and provides multi-positional limb support, which can be angled to allow for additional support. The limb support device 10 allows the medical care professional to treat all limbs of a patient at an elevation that is more ergonomic for the care professional and more comfortable for the patient, while still allowing room for the comfortable positioning of non-injured limbs. The injured area may be assessed and wound care provided without assistance from patient or another health care provider, which reduces medical costs and improves patient care.

Furthermore, the limb support device maintains extremity elevation and position without physical exertion of the patient, which reduces pain and discomfort to the patient during the dressing/change process. The device elevates the extremity to allow the health care provider access to wound(s) for dressing assessment, removal, cleansing of wound, application of new dressing product, and performance of some bedside procedures without the need of an assistant or additional staff. The limb support device is a single patient product and is reusable for that individual patient, thus, it is cost effective.

Generally, the limb support device is made of a non-porous, rigid polymer which is lightweight, stackable for shipping and storage and easily cleaned between uses, e.g., nylon, polystyrene, polypropylene, polyester, polycarbonate, copolymers, acrylic, etc. The present invention can be used in multiple settings including but not limited to: in-patient, out patient, and home care. The device is placed on a relatively flat surface such as a bed, gurney or examination table, and the patient may be positioned to achieve optimal comfort with optimal access to the extremity by the healthcare provider.

The wide base of the device allows for stability by displacement of weight downward to the bottom flat surface area where the lip on the base prevents tipping of the device and the channel that allows the extremity to be maintained/cradled for positioning. Multiple elevations allow for the patient's comfort during wound care by keeping the extremity off the flat surface and without the patient stress of having to hold the extremity up off a surface. The patient may be sitting, reclining or lying down for comfort during wound care of both upper and lower extremities.

The limb care device is in the field of human wound care, specifically wounds to extremities. The device is versatile and can be used on upper extremities but is especially useful for the treatment of lower extremity wounds including but not limited to: diabetic-neuropathic foot ulcers, stasis ulcers, arterial ulcers, cellulitis, surgical wounds (e.g., amputations) and other traumatic injuries to extremities which resulted in breaks of the skin integrity requiring wound treatment.

The device allows stabilization and positioning of the extremity with relief to patient from manipulation and physical strain/stress during wound care. In addition, the limb support device allows the health/wound care provider to safely provide wound care, unassisted while maintaining proper body mechanics to prevent back and other injury by decreasing physical strain from trying to hold and position the patient's extremity in an optimal position. Currently, healthcare providers typically position the patient's extremity by the use of pillows, which is not stable and results in the extremity sliding and creating discomfort as well as possible additional trauma to the patient's injured extremity. Additionally, there is the increased risk to the healthcare provider caused by his/her physical strain while trying to hold the extremity in position for wound care. With the increasing rate of obesity in the patient population, the increase of injuries to the provider is a real concern. Currently, back strain/injury is one of the top injuries to health care providers.

Therefore, the present invention provides a limb support device that is simple in design, requires no assembly, is versatile for most patient populations, and stable and comfortable to use due to its design and size. The limb support device can be used for a variety of injuries to extremities, and is effective for use with multiple types of wound care dressings and treatments. The limb support device is cost effective in production and provides repeated, multiple uses for a single patient. Due to its one piece molded design, it is safe, has no sharp edges, screws, pins, hinges, seams, levers or moving parts of any type to further injure the patient or health care provider. The limb support device can be made of polymers, is easily cleaned/disinfected for reuse, and is easy to store. A further advantage reduces the number of health care personnel needed to perform wound care, so the device is effective at saving time and costs to the facility. Safety features include increased comfort to the patient during wound care due to proper support, elevation and stability of the injured extremity. The present invention is versatile for use in hospitals, clinics, long-term healthcare facilities, as well as home care settings, with equal effectiveness.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the devices and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A device for limb support, positioning, and care comprising:

a non-deformable, non-porous hollow polyhedron comprising of a top, a bottom, and first, second, third and fourth sides;

wherein the top and a first side are connected along an edge of each and form an obtuse angle;

wherein the second side is connected to the top, opposite the first side, and forms an obtuse angle with the top;

wherein the third and fourth sides are disposed opposite each other and between the first and second sides;

wherein the bottom comprises an opening and further comprises one or more lips, each lip formed along the edge and extending outwardly from the opening in the bottom along the edge of at least one of the first, second, third and fourth sides; and wherein the top is defined further as being non-deformable and having a channel extending from the first side to the second side, wherein the channel defines an angled incline between the first side and the second side and the device is adapted to support a limb above a body support surface.

2. The device of claim 1, wherein the device is stackable through the opening of the bottom of adjacent stacked devices.

3. The device of claim 1, wherein the one or more lips of the bottom edges comprise a handle.

4. The device of claim 1, wherein the one or more lips provide increased stability to the device when positioned on a bed or other flat surface.

5. The device of claim 1, wherein the device is substantially rigid.

6. The device of claim 1, wherein at least one of the third and fourth sides, the top and bottom, or the first and second sides are bicentric quadrilaterals.

7. The device of claim 1, wherein the device is defined further as a container adapted to at least one of carry or store supplies.

8. A method of treating a wound comprising:

identifying a patient in need of wound care; and supporting or positioning the limb of the patient with a device comprising:

a non-deformable, non-porous hollow polyhedron comprising a top, a bottom, and first, second, third and fourth sides, wherein the top and a first side are connected along an edge of each and form an obtuse angle;

wherein the second side is connected to the top, opposite the first side, and forms an obtuse angle with the top;

wherein the third and fourth sides are disposed opposite each other and between the first and second sides;

wherein the bottom comprises an opening and further comprises one or more lips, each lip formed along the edge and extending outwardly from the opening along the edge of at least one of the first, second, third and fourth sides; and wherein the top is defined further as comprising a non-deformable surface and is an open continuous elongated elliptical groove extending from the first side to the second side at an angled incline between the first side and the second side, wherein the device is adapted to support a limb above a body support surface.

9. The method of claim 8, wherein the device is stackable through the opening of the bottom of adjacent stacked devices.

10. The method of claim 8, wherein the device further comprises a portion of the one or more lips comprises a handle.

11. The method of claim 8, wherein the one or more lips provide increased stability to the device when positioned on a bed or other flat surface.

12. The method of claim 8, wherein the device is substantially rigid.

13. The method of claim 8, wherein at least one of the third and fourth sides, the top and bottom, or the first and second sides are bicentric quadrilaterals.

14. The method of claim 8, wherein the opening is adapted to at least one of carry supplies or store supplies.

15. A medical device and container for limb care comprising:

a non-deformable, non-porous hollow container comprising a top, a bottom, and a first, second, third and fourth sides;

wherein the top and a first side are connected along an edge of each and form an obtuse angle;

wherein the second side is connected to the top, opposite the first side, and forms an obtuse angle with the top;

wherein the third and fourth sides are disposed opposite each other and between the first and second sides;

wherein the bottom comprises an opening and further comprises one or more lips, each lip formed along the edge and extending outwardly from the opening along the edge of at least one of the first, second, third and fourth sides; and wherein the top is defined further as being substantially non-deformable and comprising a channel, wherein the channel defines an incline having an angle between the first side and the second side and the device is adapted to support a limb above a body support surface.

16. The device of claim 15, wherein the device is stackable through the opening of the bottom of adjacent stacked devices.

17. The device of claim 15, wherein the device further comprises a portion of the one or more lips to comprise a handle.

18. The device of claim 15, wherein the one or more lips provide increased stability to the device when positioned on a surface.

19. The device of claim 15, wherein the device is substantially rigid.

20. The device of claim 15, wherein at least one of the third and fourth sides, the top and bottom, or the first and second sides are bicentric quadrilaterals.

21. The device of claim 15, wherein the opening is adapted to at least one of carry or store supplies.

* * * * *